United States Patent [19]

Ackeret

[11] 4,443,959

[45] Apr. 24, 1984

[54] STACKABLE PHOTOGRAPH HOLDERS

[75] Inventor: Peter Ackeret, Kusnacht, Switzerland

[73] Assignee: Licinvest AG, Chur, Switzerland

[21] Appl. No.: 357,764

[22] Filed: Mar. 12, 1982

[30] Foreign Application Priority Data

Mar. 16, 1981 [DE] Fed. Rep. of Germany ..... 3110025

[51] Int. Cl.[3] ..... G09F 1/12

[52] U.S. Cl. ..... 40/152; 40/10 R

[58] Field of Search ..... 40/152, 159, 124.2, 40/10 R; 211/194, 41, 40, 11

[56] References Cited

U.S. PATENT DOCUMENTS

| | | | |
|---|---|---|---|
| 3,419,987 | 1/1969 | Hipp | 40/152 |
| 3,635,350 | 1/1972 | Wolf | 211/40 |
| 3,791,651 | 2/1974 | Barnum et al. | 40/124.2 |
| 3,807,074 | 4/1974 | Owens et al. | 40/159 |

*Primary Examiner*—Gene Mancene

*Assistant Examiner*—Wenceslao J. Contreras

[57] ABSTRACT

Stackable storage holders for photographs are provided with a viewing window in a first side and a projecting land on the opposite side, the land being configured to fit within the window region of an adjacent holder when a plurality of the holders are stacked. A base member, provided with regions having a high coefficient of friction, is provided with a recess in its upper surface which receives a land on a holder.

16 Claims, 18 Drawing Figures

Fig. 3
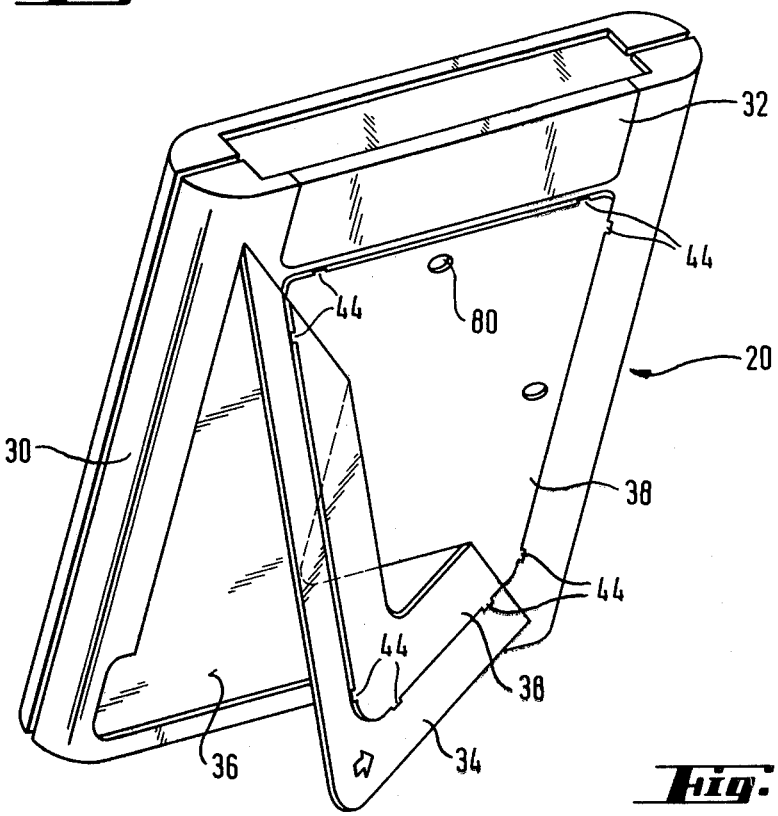
Fig. 4
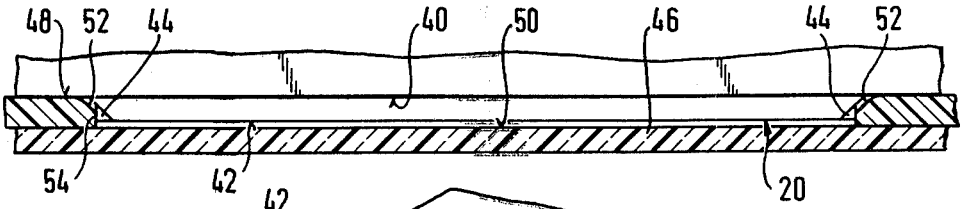
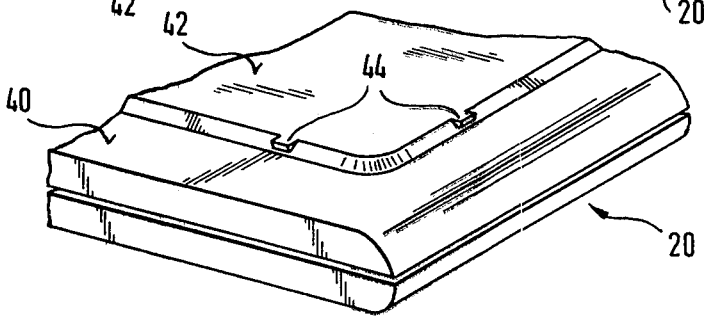
Fig. 5

Fig. 6
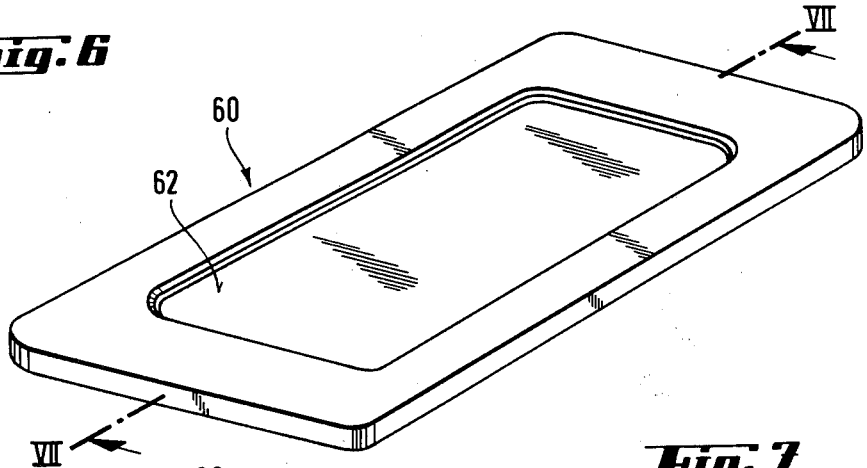
Fig. 7
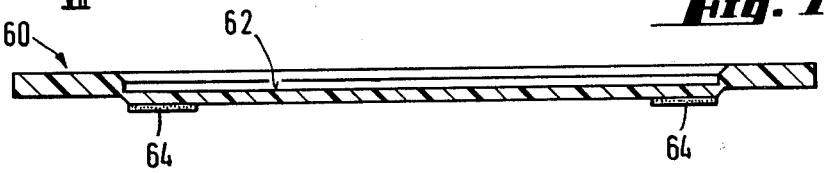
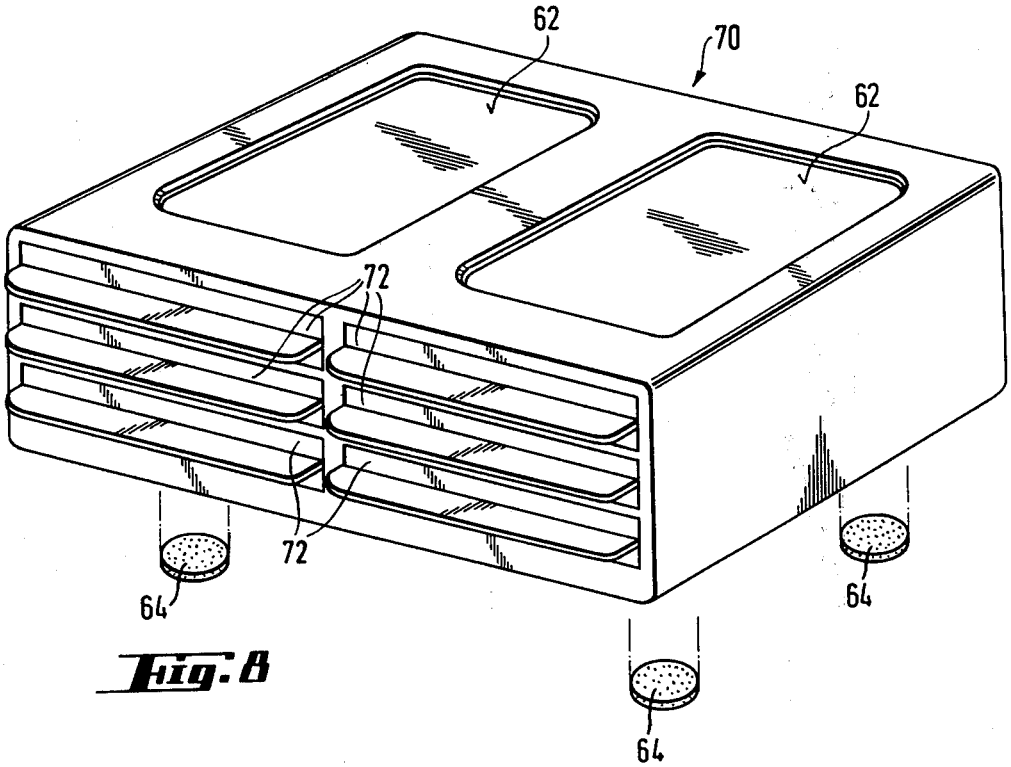
Fig. 8

Fig. 9
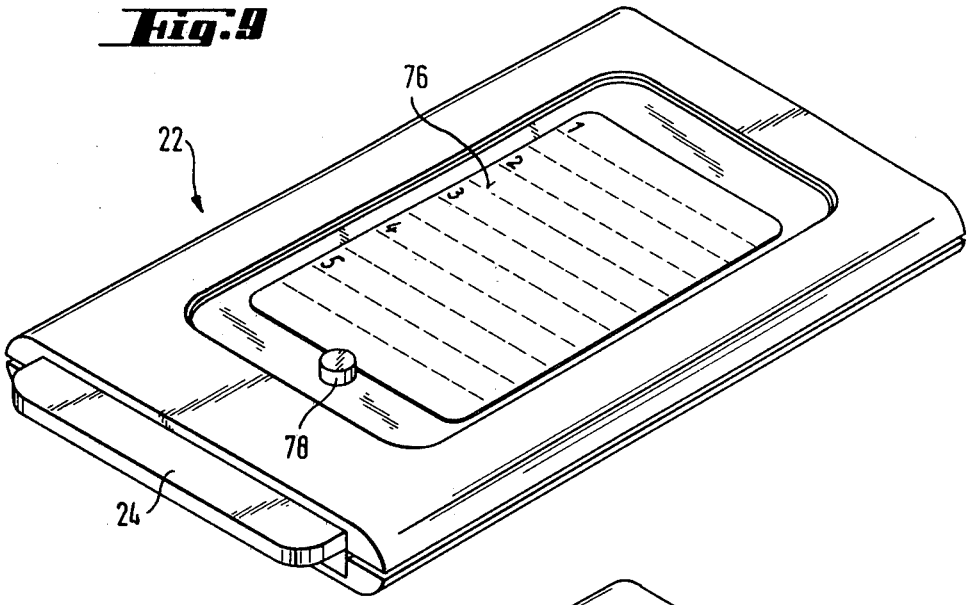
Fig. 10
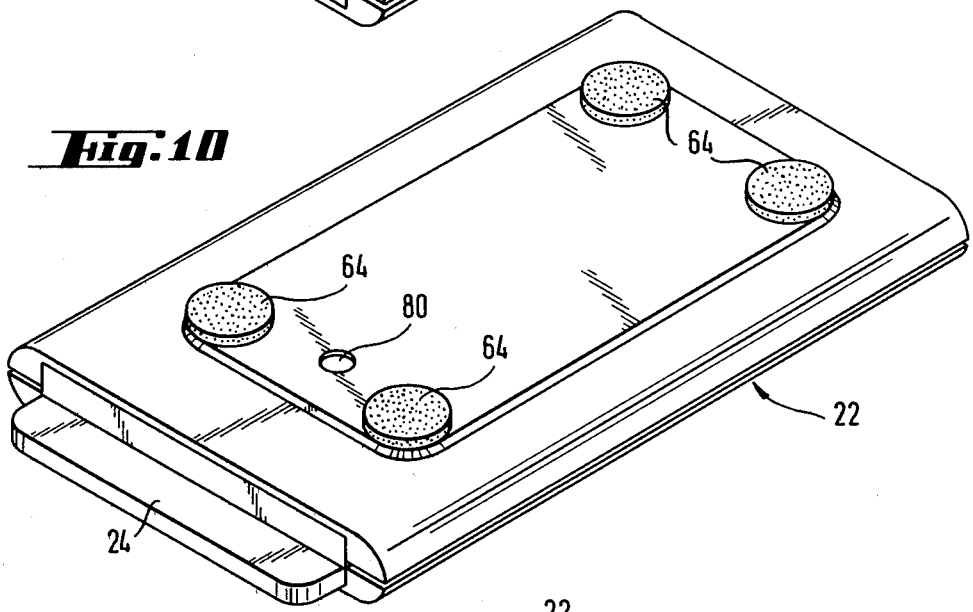
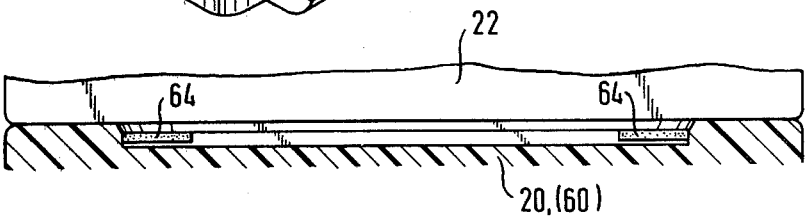
Fig. 11

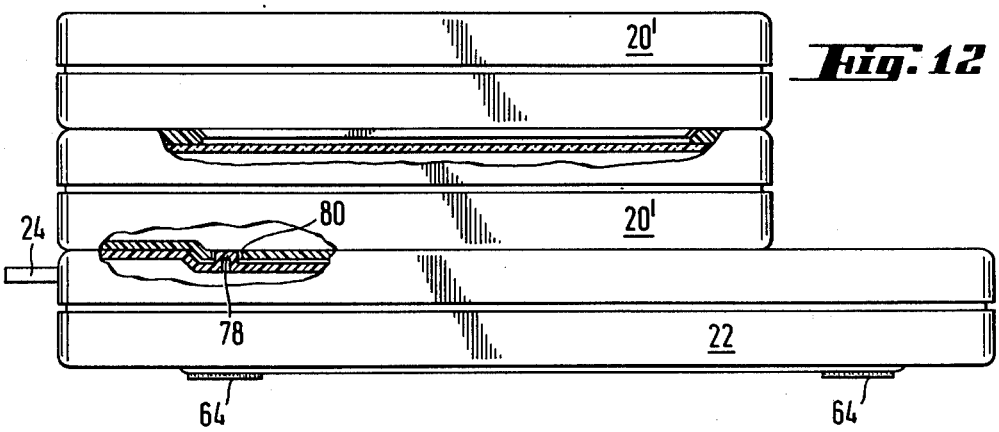
Fig. 12
Fig. 13
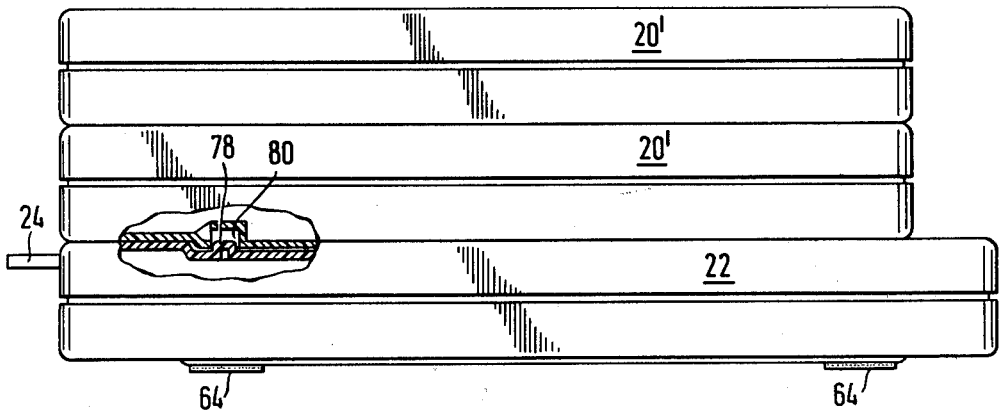
Fig. 14
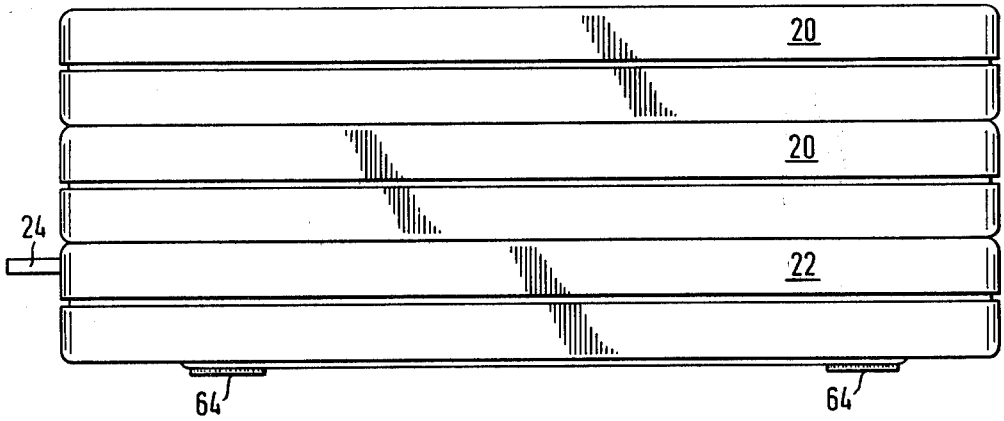

STACKABLE PHOTOGRAPH HOLDERS

BACKGROUND OF THE INVENTION

1. Field of the Invention

The present invention relates to the storage of photographs and particularly to a storage technique characterized by volumetric efficiency and stability. More specifically, this invention is directed to stackable, interlocking photograph holders and bases useable therewith. Accordingly, the general objects of the present invention are to provide novel and improved methods and articles of such character.

2. Description of the Prior Art

It is often desired that photographs be "archived" vertically in containers through which they may be viewed. While photograph holders having viewing windows are known in the art, these prior holders have not been suitable for vertical stacking in comparatively large numbers. This inability to successfully stack vertically may be attributed to the fact that the holders are typically comprised of a plastic material having a low coefficient of friction and thus have a tendency to slide relative to one another and with respect to a supporting shelf. While this relative sliding could be minimized or eliminated through the provision of slide-resistant means, for example strips or feet comprised of rubber or some other material having a high coefficient of friction, this solution involves comparatively high manufacturing costs and produces a product which is aesthetically unsatisfactory.

SUMMARY OF THE INVENTION

The present invention overcomes the above-discussed and other deficiencies and disadvantages of the prior art by providing photograph holders which may be arranged one above the other on a smooth support without there being any substantial danger of collaspe of the resulting stack and without the necessity of having to provide some slide-resistant means on each holder.

Photograph storage holders in accordance with the present invention are provided, on their upper and lower sides, with elements which interlock with complimentary elements on the lower and upper sides of similar holders. The interlocking elements on a pair of juxapositioned holders fit loosely into one another when the holders are stacked. The present invention also contemplates a base member for a stack of identical holders, the base member being provided on its underside with means having a high coefficient of friction and, on its upper side, being provided with an interlocking element which is complimentary to the interlocking element on the lower side of the holders.

A base member in accordance with the present invention may support a plurality of parallel stacks of holders and/or may include a storage region, for example in the form of a drawer, for the negatives from which the photographs housed in the stacked holders have been produced.

In accordance with a preferred embodiment, the interlocking elements on the stackable photograph holders are provided with sharp-edged contact surfaces, which cooperate to prevent relative motion, and slanting or rounded guide surfaces which facilitate the stacking process. This enables the present invention to achieve the stability, in a plurality of stacked holders, which would characterize exact interlocking but without the handling difficulty that would normally be associated with precise fitting.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which:

FIG. 3 is a perspective view, taken from the underside, of a holder in accordance with a preferred embodiment of the invention;

FIG. 4 is a partial cross-sectional, side elevation view depicting a pair of interlocked photograph holders in accordance with the invention;

FIG. 5 is a partial perspective view of the underside of the holder of FIG. 3;

FIG. 6 is a perspective view of a base member in accordance with the present invention;

FIG. 7 is a cross-sectional view taken along line 7—7 of FIG. 6;

FIG. 8 is a perspective view of another base member in accordance with the present invention;

FIG. 9 is a perspective view of still another base member in accordance with the present invention, the base member of FIG. 9 also being depicted in FIGS. 1 and 2;

FIG. 10 is a perspective view, taken from the underside, of the base member of FIG. 9;

FIG. 11 is a partial cross-sectional view depicting the interlocking relationship between a pair of stacked base elements in accordance with the present invention;

FIGS. 12, 13 and 14 are side elevation views, partly in section, of three different storage arrangements in accordance with the invention;

DESCRIPTION OF THE PREFERRED EMBODIMENT

Figures 1, 2:
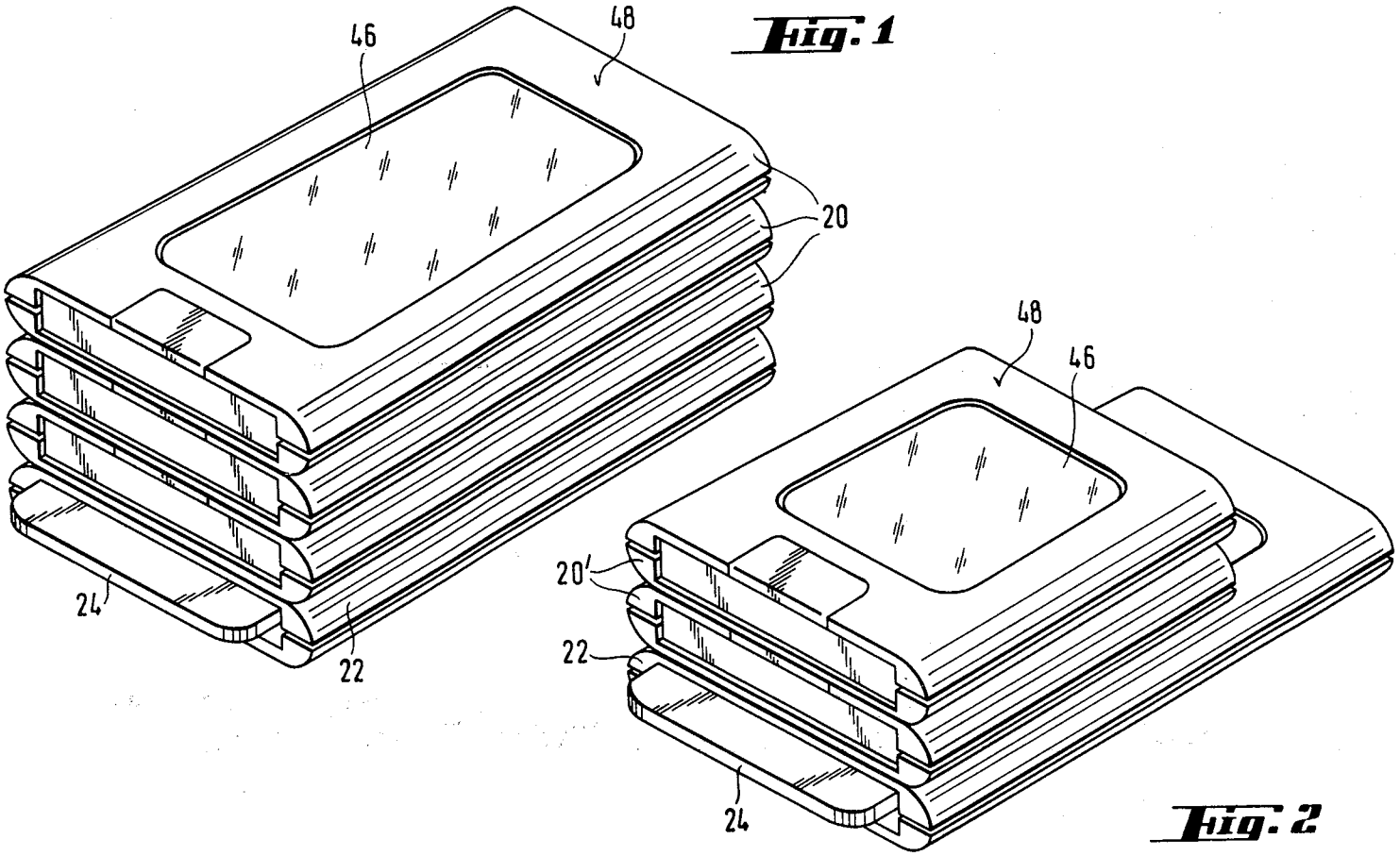
FIG. 1 is a perspective view of a storage arrangement in accordance with the present invention.
FIG. 2 is a perspective view of a slightly modified storage arrangement in accordance with the present invention.
Figure 15:
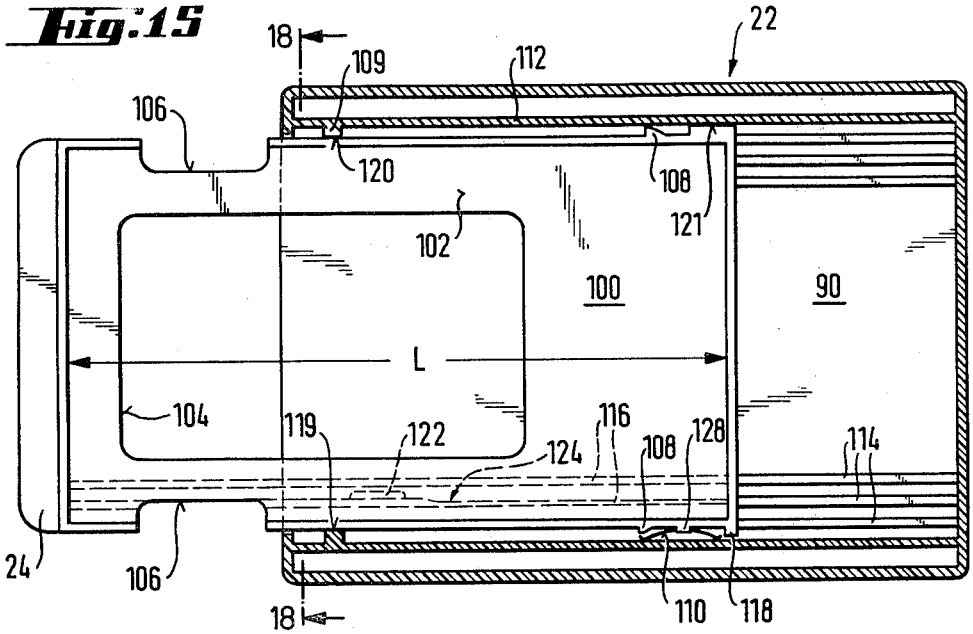
FIG. 15 is a cross-sectional top view of the base member of FIGS. 9 and 10.

With reference to the drawing, FIG. 1 shows three photograph holders 20 of the same type and size which are fitted together to form a stable composite structure or archive for storing photographs. It is to be noted that, in the discussion below, only those structural features of the holders 20 which concern their stable stacking will be described in detail. A base member or support 22 is positioned beneath the stacked holders 20. In the embodiment of FIG. 1 the base member 20 is provided with a storage drawer, access to this drawer being obtained by means of a handle 24.

The arrangement of FIG. 2 is similar to that of FIG. 1. However, in FIG. 2 the holders 20 accept a different size photograph when compared to the holders of FIG. 1. The present invention is designed such that holders for the three most common standard photo sizes, 9×9, 9×11 and 5 or 9×13 centimeters can be stacked using the same base member.

Referring to FIG. 3, a photograph holder, indicated generally at 20, comprises a housing which has been indicated generally at 30. The holder 20 also includes a slide 32 and, hinged to housing 30, a support 34. The support 34 may be either folded out, to the position shown in FIG. 3, or folded flush with the base wall 36 of housing 30. The base wall 36 and support 34 are provided with a continuous projection or land 38 which has a substantially rectangular form with rounded corners.

The profile of the land 38 may be better seen from FIGS. 4 and 5. The edge or transition between the principle level 40 of base wall 36 of housing 30 and the level 42 of the projecting land is, as illustrated, an incline or, alternatively, a rounded form for most of the outline of the edge. However, in a plurality of spaced regions, there being a total of eight (8) such regions in the FIG. 3 embodiment, the land 38 is provided with "sharp-edged" projections 44. The projections 44 extend outwardly from the sloped edge for approximately half the height of the land starting from the top, i.e., the level 34, thereof. The projections 44 have a triangular profile as shown in FIG. 4.

Referring again to FIGS. 1 and 2 each of the holders 20 is provided with a viewing window 46. The profile of the viewing windows may be seen from FIG. 4. The transition from the outermost surface area 48 of the frame surrounding the windows 46 to the lower level 50 of the window is initially slanting or rounded as indicated at 52 in FIG. 4. The lower portion of the profile of the windows, i.e., the portion which merges with the lower level or floor 50 of the windows, extends perpendicularly upwardly as indicated at 54.

As may be seen from FIG. 4, when a pair of holders 20 are stacked, the projections 44 on the lands 38 fit into the windows such that the projections 44 cooperate with the straight side portions 54. It is to be noted that the holders 20 could be positioned one above the other even without the projections 44 since the windows 46 and lands 38 are complimentary. However, since the holders are comprised of a plastic material having a low coefficient friction and are characterized by low weight, in the absence of the projections 44 there would be a lack of stability even when the holders were filled with photographs. The minimizing of the possibility of lateral movement, resulting from the cooperation between the projections 44 and the straight side wall portions 54, gives a stable arrangement and permits stacking.

It may also be noted that, instead of having a plurality of spaced projections 44, the lands 38 could be provided with a sharp edge along their entire periphery. This however, would detract from the appearance of the product and cause it to be less pleasing to the touch when being handled.

When the possibility or necessity of storing negatives is not presented, for example in the case of "instant" pictures, a base member of the type indicated generally at 60 in FIG. 6 may be employed. The base member 60 is a simple injection-molded plastic part, in plate form, having a window-like depression 62 which corresponds in shape and size to the windows 46 of the holders 20. The shape of depression 62 may be seen from FIG. 7. The plate 60 may also be provided, on its lower side, with a projecting land which is similar to the land 38 of the holders 20. A plurality of feet, as indicated at 64, will be installed such that they are aligned with the rounded corners of the depression 62 as shown. The feet 64 will be formed of rubber or some other polymer material having a high coefficient of friction. The feet 64 will either be adhesively secured to plate 60 or snapped into recesses, not shown. The positioning of the feet 64 is such that stacking of the plates 60 is permitted.

As depicted in FIG. 8, the base member, which is indicated generally at 70, may be configured such that two parallel stacks of holders can be formed. In the FIG. 8 embodiment the holder 70 is provided with six (6) storage drawers 72 for receiving negatives or strips of negatives. The base of FIG. 8 also includes anti-slip feet 64 similar to those described above in the discussion of FIGS. 6 and 7.

An individual base member, for example the base member 22 shown in FIGS. 1 and 2, is depicted in FIGS. 9 and 10 from the top and bottom sides thereof respectively. In the case of the holders the window-like depressions are actually "glazed" with a suitable transparent plastic material. In the case of the base 22, however, the bottom of the depression may be employed as an inscription area and, by way of example, a label 76 may be glued in this area. The base 22 additionally includes a peg 78 which is received in an aperture 80 in the base wall, aperture 80 being shown in FIG. 10. The peg 78 is also complimentary with suspension eyelets 80 formed in the holders (see FIG. 3) whereby the holders may function not only as standing frames but also as hanging wall frames. If the base member and picture holders are of the same size, the peg 78 is not actually necessary. However, if holders which are smaller than the base are utilized, as represented in FIG. 2, the peg 78 will insure that the holders can not slide in the axial direction inside the depressions of the base members.

FIG. 10 is a view of the bottom side of the base member 22 of FIG. 9 and clearly shows the arrangement of the anti-skid feet 64 thereon. The difference in height between the bottom surfaces of the feet 64 and the base wall which defines the projection or land is less than the depth of the depression thus insuring that the label 76 of an underlying base member will not be damaged or the transparent plastic window of an underlying photograph holder will not be scratched. This arrangement is clearly shown in FIGS. 4 and 11. It is to be noted that the height of the projection in a base member will be less than that of a land on the holders.

FIGS. 12 through 14 are side elevation views, partly in section, showing different arrangements of base members with holders stacked thereon. Thus, FIG. 12 depicts an arrangement which might be used for the archiving of photographs which are 9 cm×9 cm, FIG. 13 represents the case where the photographs are 9 cm×11.5 cm and FIG. 14 represents the case where the length of the stored photographs is 13 cm and the overall size and shape of the holders is commensurate with that of the base. In FIGS. 12 and 13 the cooperating relationship between the peg 78 and eyelet 80 is shown in the sectional portion of the view.

FIGS. 15–18 show the internal structure of a base member 22 which includes a drawer 100. The base member comprises a lower shell 90 and a upper shell, not shown, which is the mirror image thereof. The drawer 100 has a length "L" which is sufficient for the storage of strips of negatives, the film typically being cut into strips of four frames each. In order to save material, and to facilitate removal of the negatives, the bottom surface 102 of the drawer 100 is provided with an opening 104. Also in the interest of facilitating removal of negatives, finger receiving recesses 106 are provided in the opposite sides of drawer 100. The full extension of drawer 100 is determined by stops 108 thereon which cooperate with stops 109 on the shell. In this regard it is to be noted that, since the upper and lower shells are produced with the same tooling, the stops 109 will be present on both the upper and lower shells but only the stops on the upper shell will cooperate with the stops 108 on the drawer 100.

Figure 16:
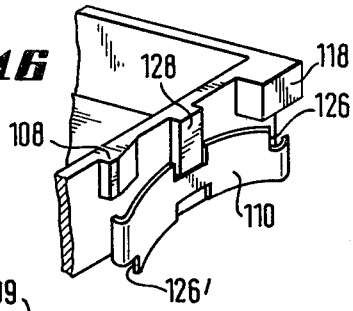
FIG. 16 is a partial perspective view of the base member shown in FIG. 15.
Figure 18:
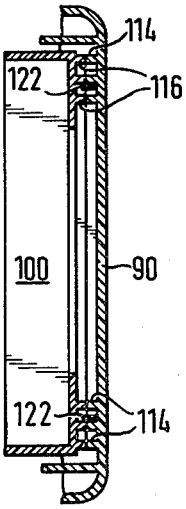
FIG. 18 is a view taken along line 18—18 of FIG. 15.

A brake spring 110, as best seen from FIG. 16, is arranged intermediate the width of the drawer and cooperates with a guide strip 112. On the base side thereof, the drawer 100 and the lower shell 90 are provided with cooperating ribs 114 and 116, respectively. The drawer is also provided with guides 118 while the shell is provided with guides 119. Further guide means for the drawer are indicated at 120 and 121. A pair of tongues 122 project upwardly from the base of lower shell 90 and are received in the space between a pair of the parallel ribs 114 of the drawer. The space between ribs 116 increases, as indicated at 124, to prevent jamming of the drawer near the fully withdrawn position.

Figure 17:
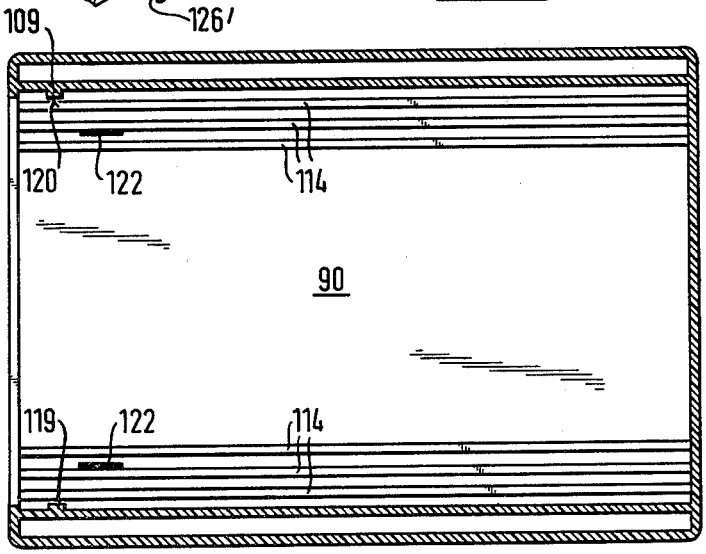
FIG. 17 is a view similar to FIG. 15 showing a base member which does not include a storage drawer.

At the insertion position, on the other hand, the drawer must be guided with some degree of accuracy in order to prevent the corners 126 of the finger recesses 106 from engaging the stops 109. The brake spring 110, as may be seen from FIG. 17, is provided with cut-out portions 126 and 126'. During assembly of the base member, when the drawer is inserted, the brake spring is fitted into the slot between two ribs 114 and the drawer is pulled thus deforming the spring which will assume the desired position on a retaining lug 128. The cut-out portion 126 on the spring permits the passage of the stop 108 while the cut-out portion 126' permits the brake spring to be installed without taking into account which end thereof is provided with the cut-out.

While preferred embodiments have been shown and described, various modifications and substitutions may be made thereto without departing from the spirit and scope of the invention. Accordingly, it will be understood that the invention has been described by way of illustration and not limitation.

What is claimed is:

1. A storage arrangement consisting of a plurality of holders, said holders each being configured for receiving at least a first photograph, said holders each having an interlocking element on the upper and lower sides thereof, the interlocking elements fitting loosely into one another when the holders are stacked, said storage arrangement further including base means, said base means including slide-resistant means on its underside and an interlocking element complementary to those on the lower side of the holders on its upper edge, said interlocking elements on the upper side of said base means and holders being defined by a transition edge between an outer higher frame portion and a central depression, said transition edge having a flat inner portion and a rounded outer portion, said interlocking elements on the lower sides of said holders each being defined by a projection which substantially matches said central depression but is shallower than said transition edge, said projections having a contour which is interrupted by flat-edged protrusions, said flat-edged protrusions fitting within the space bounded by the flat inner portion of said transition edge whereby said interlocking elements of said base means and holders comprise flat surface sections spaced from the surrounding main surfaces of the holders.

2. The storage arrangement of claim 1 wherein said slide-resistant means comprises rubber feet affixed to said base means, said feet being arranged to fit in the interlocking element on the upper side of an adjacent holder in the arrangement.

3. The storage arrangement of claim 5 wherein said transition edge is rounded in the area of the corners of the depression and the rubber feet are designed to fit in these rounded portions.

4. The storage arrangement of claim 1 wherein said holders are of different sizes and said base means depression has a size and shape commensurate with the projection of the largest holder.

5. The storage arrangement of claim 1 wherein said base means supports two holders arranged next to one another and has interlocking elements for both holders.

6. The storage arrangement of claims 1 wherein said base means further has a peg which fits into a suspension eyelet of the adjacent holder.

7. The storage arrangement of claim 1 wherein said base means has a drawer for the storage of negatives.

8. The storage arrangement of claim 1 wherein said base means further comprises a surface arranged to be inscribed upon at the bottom of said depression.

9. Apparatus for the storage of information bearing flat items comprising:

a plurality of holders, said holders each being configured for receiving at least a first of the flat items, said holders each including:

an outer higher frame portion surrounding a central depression on the upper side of the holder, said depression defining a plane; and at least a first interlocking element on each of the upper and lower sides of the holder, said upper side interlocking element being defined by at least a portion of the transition edge between the outer higher frame portion and the plane of the central depression, said lower side interlocking element being defined by a land which at least in part is substantially complementary to the central depression but is shallower than said transition edge, said transition edge having a flat inner portion and a rounded outer portion, said land having a surface which defines a plane and having a contour which is interrupted by a plurality of flat-edged projections, said flat-edged projections fitting within the space bounded by the flat inner portion of the said transition edge of an identical holder;

said interlocking elements fitting loosely into one another when the holders are stacked one upon another; and base means, said base means including slide-resistant means on its underside and an interlocking element on its upper side, said base means interlocking element being defined by at least a portion of a transition edge between an outer higher frame portion and a central depression, said base means transition edge having a flat inner portion and a rounded outer portion, said base means interlocking element depression defining a flat surface region, said base means interlocking element being at least complementary to said holder land whereby a holder may be positioned above and loosely captured by said base means, said base means transition edge being of less height than the height of said holder land whereby the surface of a land of a holder positioned on said base means will be spaced from the surface region of said base means depression.

10. The apparatus of claim 9 wherein said base means slide-resistant means comprises:

rubber feet affixed to said base means.

11. The apparatus of claim 10 wherein said transition edges on said holders and base means are rounded in the areas of the corners of the central depressions.

12. The apparatus of claim 11 wherein said slide-resistant means rubber feet are positioned so as to be received in the rounded corners of said transition edges.

13. The apparatus of claim 9 wherein said holders are of different size and said base means central depression has a size and shape commensurate with the land of the largest holder.

14. The apparatus of claim 9 wherein said base means supports two holders arranged next to one another and has an interlocking element for each holder.

15. The apparatus of claim 9 wherein said base means further includes a peg which fits into a suspension eyelet provided in an adjacent holder.

16. The apparatus of claim 9 wherein said base means further includes a drawer for the storage of negatives.

* * * * *